US005957014A

United States Patent [19]

Tseng et al.

[11] Patent Number: 5,957,014

[45] Date of Patent: Sep. 28, 1999

[54] TOOL COMBINATION HAVING TWO SECTIONS

[76] Inventors: Hung Kui Tseng, No. 84-2, Guin Gong Road; Ghi Chung Wang, No. 26-1, Lane 375, Sec. 3, Tai Yuan Road, both of Taichung; Kuo Chen Liu, No. 31, 12th Road, Gong Yeh Chu, Da Li City, Taichung Hsien, all of Taiwan

[21] Appl. No.: 09/006,304

[22] Filed: Jan. 13, 1998

[51] Int. Cl.[6] ..... B25B 23/00

[52] U.S. Cl. ..... 81/439; 81/490; 81/438

[58] Field of Search ..... 81/439, 436, 438, 81/490, 177.4

[56] References Cited

U.S. PATENT DOCUMENTS

| | | | |
|---|---|---|---|
| 2,758,494 | 8/1956 | Jenkins | 81/438 |
| 4,399,723 | 8/1983 | Marleau | 81/439 |
| 4,827,812 | 5/1989 | Markovetz | 81/439 |
| 5,337,637 | 8/1994 | Bih-Lein | 81/439 |
| 5,442,982 | 8/1995 | Bell | 81/490 |
| 5,782,146 | 6/1998 | Lin | 81/490 |
| 5,819,612 | 10/1998 | Anderson | 81/490 |

*Primary Examiner*—David A. Scherbel
*Assistant Examiner*—Lee Wilson

[57] ABSTRACT

A tool includes a base having a stud for engaging with a tool bit and includes a handle having a bore for engaging with the stud of the base. A stem is secured to the handle for engaging with the tool bit. The handle has one or more engaging channels. The base has one or more catches for engaging with the engaging channels and for securing the base to the handle and for increasing the size of the tool. The base has a latch for engaging with the handle and for further securing the base to the handle. A shaft may couple the stud of the base to the stem.

3 Claims, 3 Drawing Sheets

TOOL COMBINATION HAVING TWO SECTIONS

BACKGROUND OF THE INVENTION

1. Field of the Invention

The present invention relates to a tool, and more particularly to a tool having two or more sections that may be coupled together for forming a larger tool.

2. Description of the Prior Art

Typical tools, particularly the screw drivers, comprise a handle and a driving stem secured to the handle for engaging with and for driving the screws or bolts. However, the handle of the tool normally includes a size that may not be reduced, such that the handle may not be easily engaged with the fasteners that are engaged in tiny spaces.

The present invention has arisen to mitigate and/or obviate the afore-described disadvantages of the conventional tools.

SUMMARY OF THE INVENTION

The primary objective of the present invention is to provide a tool including two or more handle members that may be secured together for forming a tool having a larger handle.

In accordance with one aspect of the invention, there is provided a tool combination comprising a base including a first end having a stud, the stud including an engaging hole for engaging with a tool bit, a handle including a first end having a bore for engaging with the stud of the base and including a second end, a stem including a first end secured in the second end of the handle and including a second end for engaging with the tool bit, and means for securing the base to the handle in order to increase a size of the tool combination.

The base includes at least one catch disposed on the first end of the base, the first end of the handle includes at least one engaging channel for engaging with the catch and for securing the base to the handle. The first end of the handle includes a cavity, the base includes a latch for engaging with the cavity of the handle and for securing the base to the handle. A shaft is further provided for coupling the stud of the base to the stem.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
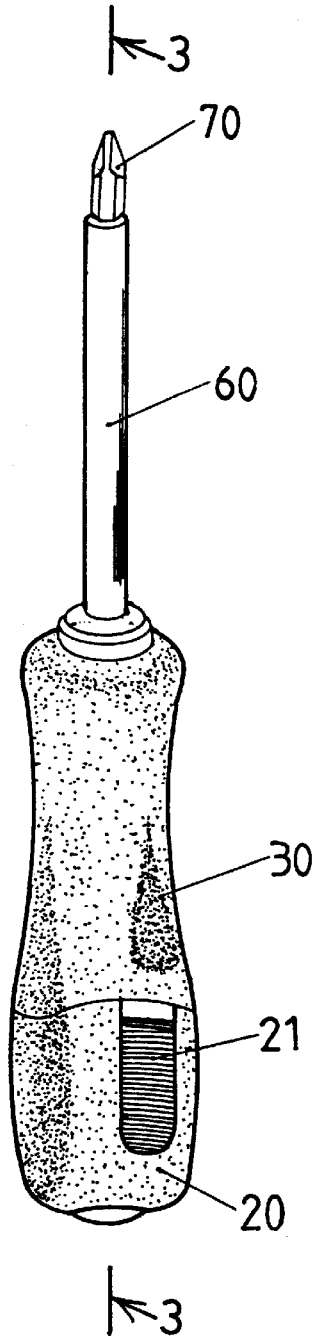
FIG. 1 is a perspective view of a tool combination in accordance with the present invention.
Figure 2:
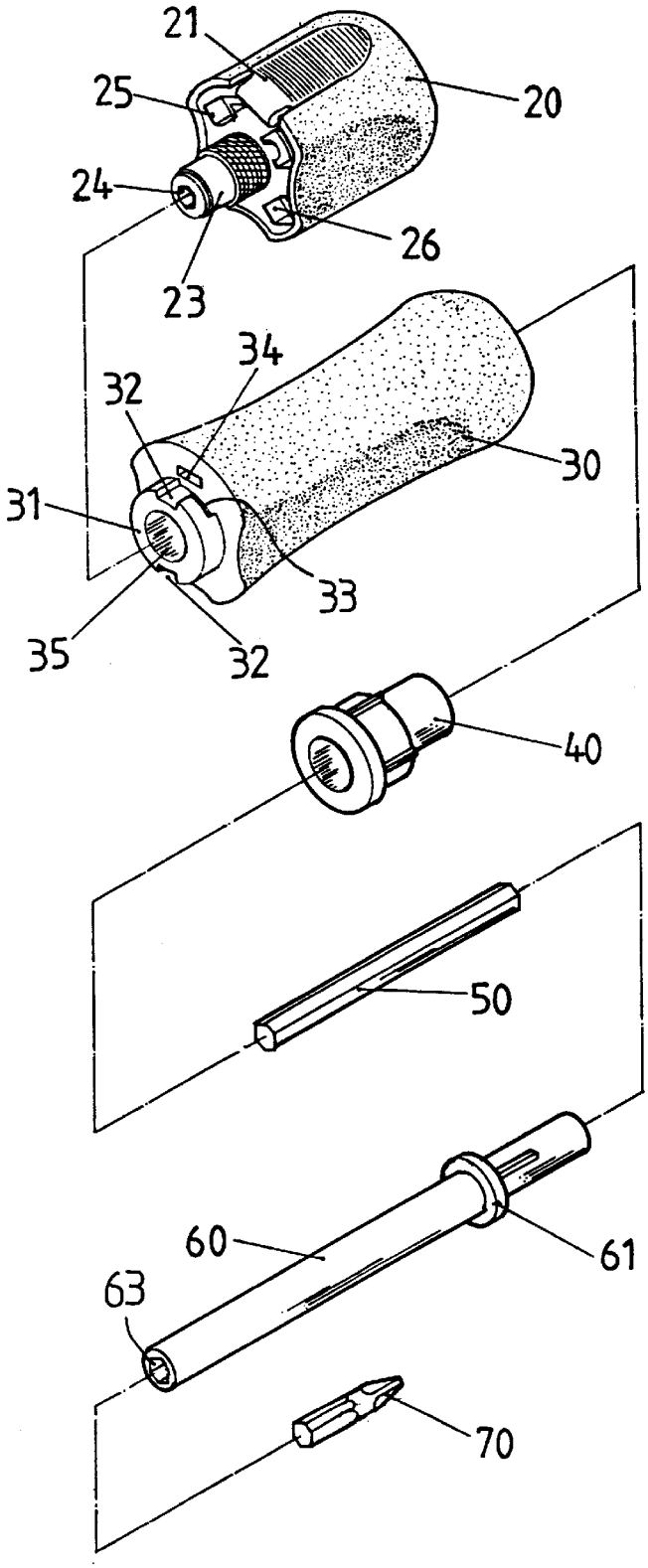
FIG. 2 is an exploded view of the tool combination.
Figure 3:
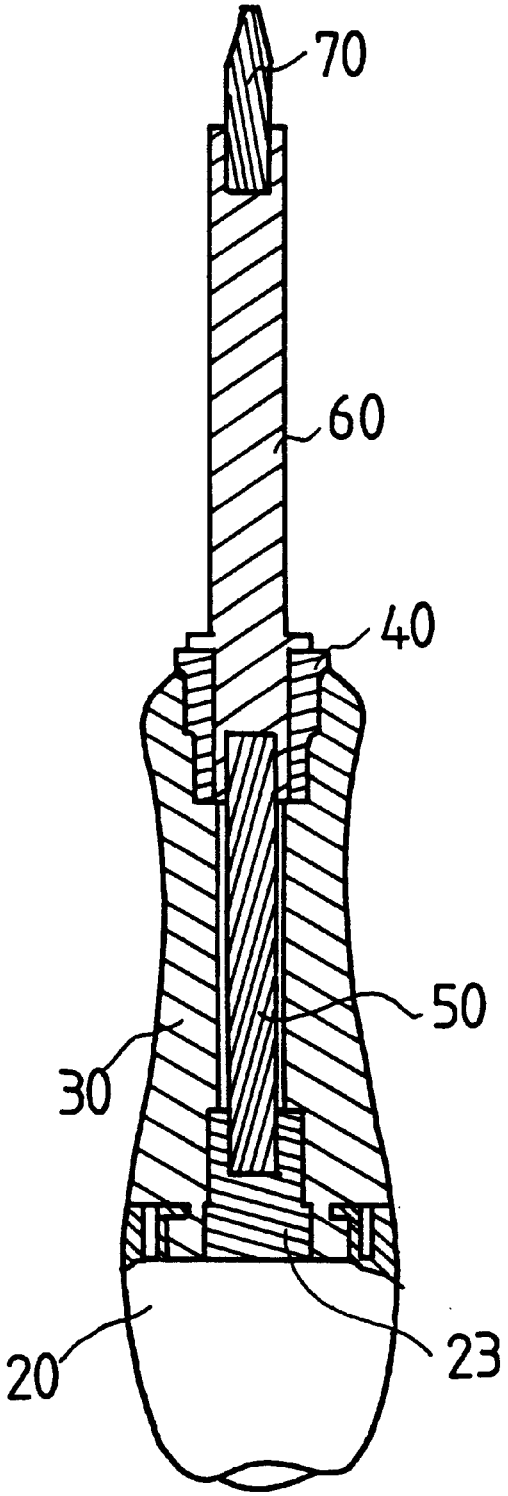
FIG. 3 is a cross sectional view taken along lines 3—3 of FIG. 1.

Referring to the drawings, and initially to FIGS. 1–3, a tool combination in accordance with the present invention comprises a base 20 including a stud 23 and one or more catches 25, 26 extended from one end. The stud 23 has an engaging hole 24 for engaging with a tool bit 70 (FIG. 4) and for forming a tool having a shorter handle. A latch 21 is slidably engaged in the side portion of the base 20. A ratchet mechanism may be engaged in the base 20 and a knob 22 (FIG. 2) may be used for controlling the ratchet mechanism. The ratchet mechanism is not related to the present invention and will not be discussed in further details.

A handle 30 includes a bore 35 for engaging with the stud 23 and includes one or more L-shaped recesses 32 formed in one end 31 for engaging with the catches 25, 26 of the base 20. The recesses 32 each has a channel 33 for engaging with the catches 25, 26. The handle 30 includes a cavity 34 formed in the end 31 for engaging with the latch 21 which may solidly secure the base 20 to the handle 30. A sleeve 40 is secured in the other end of the handle 30. A stem 60 has one end engaged in the sleeve 40 and includes a collar 61 engaged with the handle 30 for preventing the stem 60 from engaging into the handle 30. The stem 60 includes an engaging hole 63 formed in one end for engaging with a tool bit 70 and another engaging hole formed in the other end (FIG. 3) for engaging with a shaft 50 which may also be engaged with the engaging hole 24 of the base 20 for coupling the stem 60 to the base 20 and for allowing the stem 60 to be rotated by the base 20 via the shaft 50.

Figure 4:
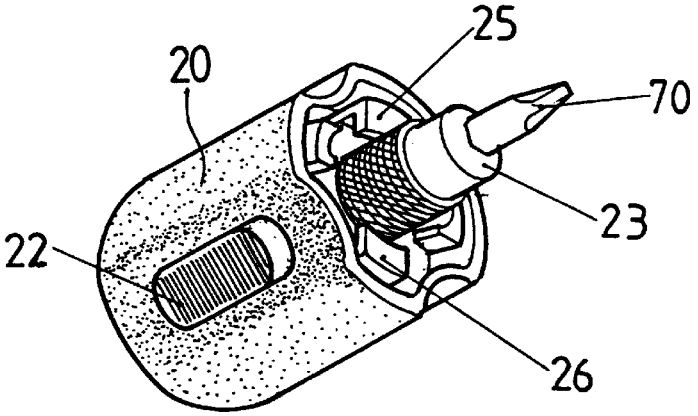
FIG. 4 is a perspective view illustrating the operation of the shorter handle member.

In operation, as shown in FIG. 4, the base 20 may also be used as a shorter handle for driving the tool bit 70. As shown in FIG. 3, the handle 30 and the base 20 may be used for rotating the stem 60 and the tool bit 70. Alternatively, the stem 60 may include one end solidly secured to the handle 30 by such as key engagement such that the stem 60 may also be rotated by the handle 30 without the base 20 and the shaft 50. The base 20 may be used for increasing the size of the tool combination.

Accordingly, the tool combination in accordance with the present invention includes two or more handle members that may be secured together for forming a tool having a larger handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tool combination comprising:

a base including a first end having a stud, said stud including an engaging hole for engaging with a tool bit, a handle including a first end having a bore for engaging with said stud of said base and including a second end, a stem including a first end secured in said second end of said handle and including a second end for engaging with the tool bit, and means for securing said base to said handle in order to increase a size of said tool combination, said base including at least one catch disposed on said first end of said base, said first end of said handle including at least one engaging channel for engaging with said at least one catch and for securing said base to said handle.

2. The tool combination according to claim 1, wherein said first end of said handle includes a cavity, said base includes a latch for engaging with said cavity of said handle and for securing said base to said handle.

3. The tool combination according to claim 1 further comprising means for coupling said base to said stem.

* * * * *